United States Patent [19]

Hansen

[11] Patent Number: 4,653,573

[45] Date of Patent: Mar. 31, 1987

[54] CONNECTING APPARATUS FOR A RADIATOR

[75] Inventor: Knud A. Hansen, Sonderborg, Denmark

[73] Assignee: Danfoss A/S, Nordborg, Denmark

[21] Appl. No.: 790,878

[22] Filed: Oct. 24, 1985

[30] Foreign Application Priority Data

Oct. 30, 1984 [DE] Fed. Rep. of Germany ..... 3439585

[51] Int. Cl.[4] ..... G05D 23/02

[52] U.S. Cl. ..... 165/33; 137/563; 165/103; 165/137; 237/56

[58] Field of Search ..... 165/33, 34, 35, 49, 165/101, 103, 137; 137/563; 236/42, 43; 237/56, 70, 71, 72, 73

[56] References Cited

U.S. PATENT DOCUMENTS

| | | | |
|---|---|---|---|
| 348,615 | 9/1886 | Carman | 237/70 X |
| 1,816,320 | 7/1931 | Flynn | 236/40 X |
| 1,825,306 | 9/1931 | Clark | 165/103 |
| 3,001,479 | 9/1961 | Swenson et al. | 237/56 X |
| 3,901,438 | 8/1975 | Christiansson | 165/35 X |
| 3,934,609 | 1/1976 | Haggqvist | 137/563 X |
| 4,032,068 | 6/1977 | Luchtenberg et al. | 165/35 X |
| 4,367,785 | 1/1983 | Allen | 137/563 X |
| 4,397,418 | 8/1983 | Johansson et al. | 137/563 X |

FOREIGN PATENT DOCUMENTS

| | | | |
|---|---|---|---|
| 1101725 | 3/1961 | Fed. Rep. of Germany | 237/56 |
| 1163866 | 2/1964 | Fed. Rep. of Germany | 165/35 |
| 2311080 | 9/1974 | Fed. Rep. of Germany | 236/70 |
| 2520159 | 11/1976 | Fed. Rep. of Germany | 165/35 |
| 2708205 | 8/1978 | Fed. Rep. of Germany | 165/49 |
| 2936027 | 3/1980 | Fed. Rep. of Germany | 236/43 |
| 850923 | 12/1939 | France | 165/35 |
| 1319184 | 1/1963 | France | 165/103 |
| 490631 | 2/1954 | Italy | 165/35 |

*Primary Examiner*—Albert W. Davis, Jr.
*Assistant Examiner*—Randolph A. Smith
*Attorney, Agent, or Firm*—Wayne B. Easton; Clayton R. Johnson

[57] ABSTRACT

The invention relates to apparatus for connecting a radiator to a single or double tube type hot water central heating system. The connecting apparatus includes a conventional thermostatic valve and a conventional valve controlled bypass between the inlet and outlet connectors of the connecting apparatus. A constructural feature which results in lower manufacturing costs and a lower stock inventory for thermostats involves a return passage from the radiator outlets which has a setting valve that is actuatable independently of the bypass valve.

4 Claims, 2 Drawing Figures

CONNECTING APPARATUS FOR A RADIATOR

Figure 1:
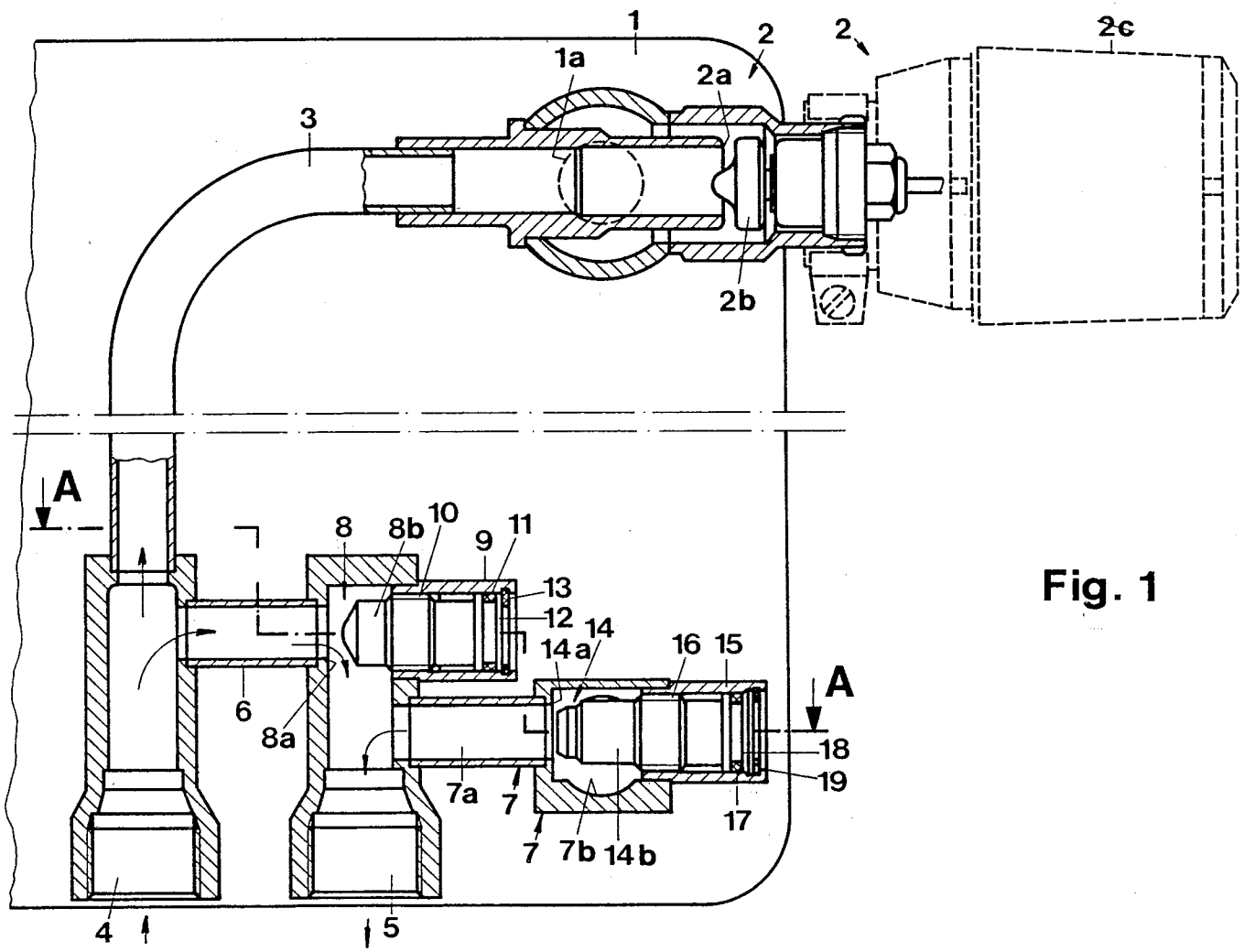

The invention relates to a connecting apparatus for a radiator of a single or double tube hot water central heating installation, comprising a supply and return connector for respectively connecting to the supply and return conduits of the central heating installation, a bypass passage connecting the supply and return connectors, a bypass valve for the bypass passage, a supply passage having a thermostatic valve and disposed between the supply connector and an inlet aperture of the radiator, and a return passage between an outlet aperture of the radiator and the return connector.

In a known connecting apparatus of this type, the throttle member of the bypass valve in the form of a separating screw with an internal hexagon can, after removing a closure screw which is inserted in a tapped hole in the wall of the return connector opposite to the throttle member of the bypass valve, be removed from the bypass passage when it is intended to connect the radiator to a single tube hot water central heating installation by means of the connecting apparatus. On the other hand, the bypass passage will be blocked by screwing the throttle member in when the radiator is to be connected to a double tube hot water central heating installation. For each size of radiator, one must provide a particular thermostatic valve having a maximum throughflow to suit the size of the radiator or a thermostatic valve which can be set to the maximum throughflow. This requires a large stock of the most varied thermostatic valves corresponding to the particular radiator sizes or it requires the use of thermostatic valves of which the maximum throughflow can be set to the particular radiator size. When employing a thermostatic valve which cannot be set to the radiator size, its installation is in practice possible only when the radiator is in situ, whereas preadjustable thermostatic valves are expensive.

It is the object of the invention to provide a connecting apparatus of the aforementioned kind in which the expense with respect to the manufacture and keeping stock is lower.

According to the invention, this problem is solved in that the return passage has a setting valve which is actuatable independently of the bypass valve.

In this construction of the connecting apparatus, the same simple thermostatic valves can be employed for all the radiator sizes because the setting of the throughflow to suit the particular radiator size can be effected by means of the setting valve. The use of uniform components simplifies production and holding parts in stock. Further, the connecting apparatus and radiator can be pre-assembled independently of whether the connection is to be to a single or double tube hot water central heating installation. For a particular application, it is merely necessary to set the bypass valve correspondingly. The setting of the bypass and setting valves can be carried out independently.

The thermostatic valve, bypass valve and setting valve as well as the supply connector, return connector, supply passage and bypass passage may be disposed with parallel axes in a plane parallel to one side wall of the radiator. This results in a compact construction economical for keeping stock.

Further, the return passage may form a T tube of which the transverse member connects two parallel heating plates and its longitudinal member is connected to the return connector and has a valve seat of the setting valve, a throttle member of the setting valve being sealingly passed through a wall of the transverse member opposite to this valve seat and being adjustable by way of a screwthread. In this way, the space between the heating plates is utilized to result in a compact construction and yet the setting valve is readily accessible and adjustable.

The throttle member of the setting valve may have an externally exposed section engageable by a screwdriver. The throttle member is therefore directly accessible and does not require its own cumbersome manual actuating member.

Further, the opening stroke of the throttle member of the setting valve may be limited. This facilitates setting.

In a connecting apparatus in which the bypass passage comprises a valve seat of the bypass valve and this valve seat co-operates with a throttle member having a screwthread for adjustment, the throttle member of the bypass valve can likewise be sealingly passed through a wall of the return connector opposite to the valve seat of the bypass valve. This likewise ensures a compact construction with easy operability.

In particular, the throttle member of the bypass valve may likewise have an externally exposed section engageable by a screwdriver. This throttle member will then likewise be accessible directly without requiring its own cumbersome manual actuating member.

The opening stroke of the throttle member of the bypass valve may likewise be limited to simplify setting.

If the rotary axes of the throttle members are superposed, the throttle members will be readily accessible from one side, preferably the front of the radiator.

In more detail, each throttle member may be guided in a sleeve, sealed from the inside of the sleeve by a sealing ring and limited in stroke by a securing ring. This dispenses with an externally securing and sealing closure screw for each valve.

Figure 2:
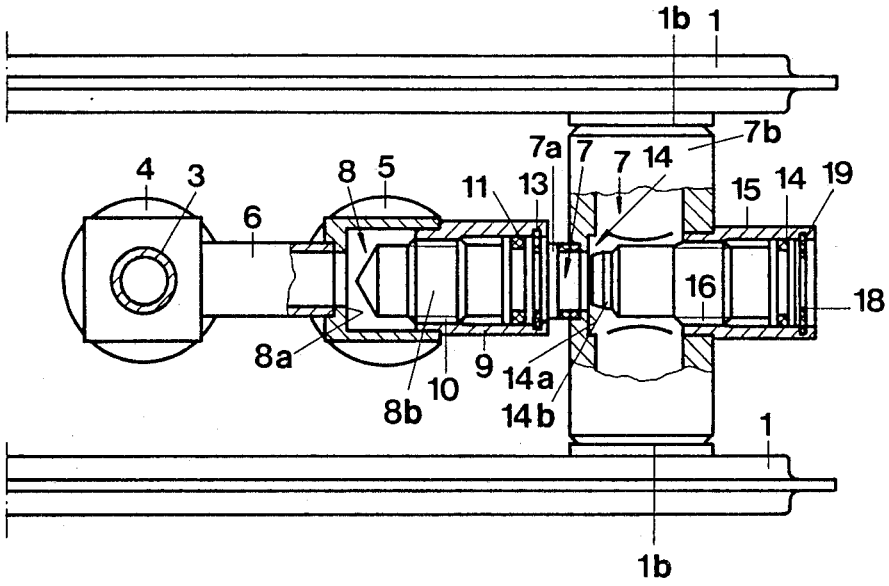

A preferred example of the invention and its developments will now be described with reference to the drawing, wherein:

FIG. 1 is a part-sectional side elevation of a connecting apparatus according to the invention and part of a connected heating plate of a radiator, and FIG. 2 is a plan view of the connecting apparatus according to FIG. 1, partly sectioned on the line A—A in FIG. 1, with the heating plates of a radiator connected to both sides.

The connecting apparatus shown in FIGS. 1 and 2 is connected in a central plane between two parallel heating plates 1 of a radiator of a single or double tube hot water heating installation, the one heating plate 1 being omitted in FIG. 1. The connecting apparatus comprises a conventional thermostatic valve 2 with a valve seat 2*a*, a throttle member 2*b* and a thermostatic attachment 2*c* actuating the throttle member 2*b* in response to the surrounding temperature. The thermostatic valve 2 is disposed in a supply passage 3 connected on the one hand to a supply connector 4 and on the other hand to each inlet aperture 1*a* of the heating plates 1. Connected to the supply connector 4 by way of a bypass -passage 6 there is a return connector 5 having a tube. A return passage 7 formed by a T tube has its longitudinal member 7*a* connected to the return connector 5 while its transverse member 7*b* interconnects the outlet apertures 1*b* of the heating plates 1.

The bypass passage 6 can be blocked by a bypass valve 8 of which the valve seat 8*a* is formed by the mouth of the bypass passage 6 in the return connector 5 and the throttle member 8*b* is mounted in a guide sleeve 9. The guide sleeve 9 is sealed in a wall of the return connector 5 that is opposite to the valve seat 8*a*. In the guide sleeve 9, the throttle member 8*b* is adjustable by a screwthread 10 coaxially to the valve seat 8*a* and is sealed by a sealing ring 11 from the inside of the guide sleeve 9. A head 12 of the throttle member 8*b* is provided with a slot, crossed slot or polygon for engagement by a screwdriver for setting the throttle member 8*b*. The opening stroke of the throttle member 8*b* is limited by a substantially C-shaped resilient securing ring 13 which is inserted in an internal groove of the guide sleeve 9.

In the return passage 7 there is a setting valve 14 with a valve seat 14*a* which is formed by the mouth of the longitudinal member 7*a* of the return passage 7 in the transverse member 7*b* and with a throttle member 14*b*. The throttle member 14*b* is mounted in a guide sleeve 15 which is sealed in the wall of the transverse member 7*b* opposite to the valve seat 14*a*. The throttle member 14*b* is adjustable in the guide sleeve 15 coaxial to the valve seat 14*a* by means of a screwthread 16 and is sealed by a sealing ring 17 from the insides of the guide sleeve 15. A head 18 of the throttle member 14*b* is provided with a slot, crossed slot or polygon as a section for engagement by a screwdriver for setting the throttle member 14*b*. The opening stroke of the throttle member 14*b* is limited by a substantially C-shaped resilient securing ring 19 which is inserted in an inner groove of the guide sleeve 15.

The axes of the parts 2 to 6, 7*a* and 8 to 19 all lie in a vertical plane parallel to the side walls of the heating plates 1, the axes of the connectors 4 and 5 extending vertically and those of valves 2, 8 and 15 horizontally and being superposed so that the valves are readily accessible from the front of the radiator for setting purposes.

The supply and return conduits of a single or double tube hot water central heating installation are connected to the connectors 4 and 5 from below. To operate a plurality of radiators 1 in shunt when connecting the connectors 4 and 5 to a single tube hot water central heating installation, the setting valve 14 is opened completely and the bypass valve 8 is opened until part of the hot water coming through the supply connector 4 flows by way of the supply passage 3 into the radiator 1 and part flows through the bypass passage 6 and the return connector 5 directly into the return conduit to the next radiator as is indicated by the arrows in FIG. 1. To operate a plurality of radiators 1 in series when connected to a single tube hot water central heating installation or in parallel when connected to a double tube hot water central heating installation, the bypass valve 8 is closed and the setting valve 14 in the return passage 7 is set to a flow corresponding to the desired maximum temperature of the radiator or the series connected radiators when the thermostatic valve 2 is fully open.

What is claimed is:

1. A connection apparatus for connecting the inlet and outlet apertures of a radiator to single and double tube type hot water central heating installations, comprising, supply and return conduit means having respective supply and return connectors, said supply conduit means having a thermostatic valve and extending from said supply connected to said radiator inlet aperture, bypass passage means connecting said supply and return conduit means, an adjustable bypass valve for said bypass passage means, said return conduit means extending from said radiator outlet aperture to said return connector, and an adjustable setting valve for said return conduit means that is connected to the return conduit means between the connection of the bypass means to the return conduit means and the return connector, the setting valve being adjustable independent of said bypass valve.

2. Apparatus according to claim 1 characterized in that said thermostatic valve, said bypass passage means and said bypass valve, and said return conduit means and said setting valve are all arranged with parallel axes in a plane which is parallel to one side wall of said radiator.

3. Apparatus according to claim 2 wherein said radiator has two parallel plates that each has one of said outlet apertures, characterized in that said return conduit means includes a T tube having a transverse member connected to each of the parallel plate radiator outlet apertures and a longitudinal member connected to said return connector, said return conduit means having a valve seat, said setting valve having a screwthread adjustable throttle element cooperable with said valve seat.

4. Apparatus according to claim 3 characterized in that said throttle element of said setting valve has an externally exposed section engageable by a screwdriver.

* * * * *